US005678799A

United States Patent [19]

Jorgensen et al.

[11] Patent Number: 5,678,799

[45] Date of Patent: Oct. 21, 1997

[54] ADJUSTABLE HANGER ASSEMBLY

[75] Inventors: Robert W. Jorgensen; Richard D. Swanson, both of Niles, Mich.

[73] Assignee: Hubbell Incorporated, Orange, Conn.

[21] Appl. No.: 618,753

[22] Filed: Mar. 20, 1996

Related U.S. Application Data

[63] Continuation-in-part of Ser. No. 481,625, Jun. 7, 1995, abandoned.

[51] Int. Cl.[6] ..... B42F 13/00

[52] U.S. Cl. ..... 248/343; 248/200.1

[58] Field of Search ..... 248/200.1, 343, 248/344, 342, 906, 57

[56] References Cited

U.S. PATENT DOCUMENTS

| | | | |
|---|---|---|---|
| Re. 33,147 | 1/1990 | Reiker | 248/200.1 |
| 2,316,389 | 4/1943 | Atkinson | 248/200.1 |
| 2,809,002 | 10/1957 | Rudolph | 248/57 |
| 2,945,661 | 7/1960 | Appleton | 248/57 |
| 3,163,386 | 12/1964 | Collins | 248/57 |
| 4,050,603 | 9/1977 | Harris et al. | 220/3.9 |
| 4,463,923 | 8/1984 | Reiker | 248/546 |
| 4,538,786 | 9/1985 | Manning | 248/544 |
| 4,645,158 | 2/1987 | Manning | 248/343 |
| 4,659,051 | 4/1987 | Propp et al. | 248/546 |
| 4,682,452 | 7/1987 | Proppe et al. | 52/118 |
| 4,909,405 | 3/1990 | Kerr, Jr. | 220/3.9 |
| 5,044,582 | 9/1991 | Walters | 248/57 |
| 5,150,868 | 9/1992 | Kaden | 248/343 |
| 5,303,894 | 4/1994 | Deschamps et al. | 248/343 |
| 5,330,137 | 7/1994 | Oliva | 248/27.1 |

*Primary Examiner*—Ramon O. Ramirez

*Attorney, Agent, or Firm*—Jerry M. Presson; David L. Tarnoff

[57] ABSTRACT

A hanger assembly for mounting and supporting an electrical box or other fixture is formed from two identical complementary hanger support members. The support members are slidably coupled together for selectively adjusting the length of the assembly. Each of the support member is formed from a blank, and includes a body portion with a hook-shaped coupling member at one end for coupling the body portion of the complementary support member thereto and a mounting tab at the opposite end for coupling a structural support thereto. The support members also include a supporting flange along a lower longitudinal edge for coupling and supporting the electrical box or other fixture thereto.

39 Claims, 8 Drawing Sheets

ADJUSTABLE HANGER ASSEMBLY

RELATED APPLICATION

This application is a continuation-in-part application of Ser. No. 08/481,625, filed on Jun. 7, 1995 now abandoned.

FIELD OF THE INVENTION

The present invention is directed to an adjustable hanger assembly. More particularly, the invention is directed to a hanger assembly for supporting a heavy load such as an electrical box with a heavy fixture or ceiling fan between a pair of supports such as joists.

BACKGROUND OF THE INVENTION

Electrical boxes are often mounted in the ceiling of buildings for containing electrical wiring for lighting fixtures and other purposes. In many applications, electrical fixtures, such as, for example, ceiling fans, lights or similar devices, are mounted directly to the electrical box. The standard mounting systems for electrical boxes which are not securely attached to a structural support are inadequate for supporting ceiling fans and other heavy electrical fixtures. Failure to properly mount the electrical junction box can result in the ceiling fan or fixture falling, thereby causing personal injury or damage to the building.

Several mounting assemblies have been proposed in the past for securing and supporting ceiling fans or other fixtures to the ceiling. These assemblies are usually attached to the ceiling joints by a brace, bar or rod extending between the joists. Many of these braces are not continuously adjustable. One type of mounting brace includes a pair of telescoping pipes or hollow rods which are expanded to engage the opposing joists. The rods can be coupled by a threaded coupling so that rotation of one rod with respect to the other causes the assembly to expand linearly until the distal ends of the rods fictionally engage the ceiling joists. Other mounting braces may also include sharp prongs or teeth which are driven into the joists by the force applied by the rotation of the rods. A disadvantage of this type of brace is that continuous vibration of a ceiling fan can loosen the threaded coupling thereby permitting the brace and electrical junction box to break free. Although locking mechanisms can be provided to prevent the threads from backing off, this inherently increases the complexity of manufacture. In addition, the two sections of the brace require separated tooling and machining, thereby increasing the cost of the brace.

Other mounting devices for supporting ceiling fans can include a hook shaped element having a threaded shank. The threaded shank is screwed into the ceiling joist or other support and the fan is attached to the hook. This arrangement is generally unacceptable for reversible ceiling fans since the torque of the fan can cause the threaded shank to unscrew thereby causing the fan to fall.

A further disadvantage of the prior ceiling mounting braces is the difficulty and time required to retrofit an existing building. The mounting brace is usually supplied by the manufacturer in the collapsed condition. A substantial amount of time can be required to expand the brace to the proper length. In particular, braces having telescoping bars threadedly coupled together can be time consuming if it must be expanded more than a few inches to engage the ceiling joists. In addition, it can be difficult to apply the necessary torque to imbed the prongs into the support structure.

Examples of the previous ceiling mounting braces are disclosed in U.S. Pat. Nos. 4,463,923; 5,150,868; Re 33,147; 4,538,786; 4,909,405 and 5,303,894. Although these mounting braces can be generally effective and provide adequate strength, they can be expensive to manufacture and difficult to mount properly and safely. Accordingly, there is a continuing need in the industry for a simple and effective mounting brace capable of supporting heavy fixtures.

SUMMARY OF THE INVENTION

A primary object of the present invention is to provide a heavy duty hanger assembly that is able to mount and support heavy loads, such as ceiling fans, lighting fixtures or other electrical fixtures.

A further object of the present invention is to provide a hanger assembly that is inexpensive to manufacture and easy to install.

Another object of the invention is to provide a hanger assembly that is easily extendable from a fully retracted position to a fully extended position to be easily fixed to opposing supports.

Still another object of the present invention is to provide a hanger assembly that can be easily fastened to ceiling joists or other supports using readily available screw fasteners.

A further object of the present invention is to provide a hanger assembly to which a standard electrical junction box can be easily coupled thereto.

Another object of the present invention is to provide a hanger support member made from a folded sheet which when coupled to an identical support member forms an adjustable hanger assembly.

A further object of the present invention is to provide an expandable hanger assembly formed from two identical support members which are slidably connected together.

Still another object of the present invention is to provide a hanger assembly having two identical support members where each section is formed from a folded blank.

The foregoing objects of the invention are basically attained by providing a hanger assembly for supporting a load between a pair of substantially parallel spaced-apart supports, the hanger assembly comprising: first and second complementary support members slidably coupled together, each of the support members being formed from a sheet material and including; a body portion having a longitudinal dimension, with first and second ends, and first and second longitudinal side edges; a hook-shaped coupling member coupled to the first side edge for slidably engaging the first side edge of the complementary support member; a load supporting flange coupled to the second longitudinal side edge of the body portion and extending substantially perpendicular to the body portion; and a mounting tab coupled to the first end of the body portion and extending substantially perpendicular to the body portion.

The foregoing objects of the present invention are also attained by providing a support member formed of a rigid sheet material comprising; a body having a longitudinal dimension, with first and second ends, and first and second longitudinal side edges; a hook-shaped coupling member coupled to the first side edge by a first fold line, the coupling member including at least a first portion extending outwardly from the body portion at the first fold line and a second portion extending from the first portion via a second fold line to define a hook-shaped coupling member for slidably engaging the first side edge of a complementary support member; a load supporting flange coupled to the second longitudinal side edge of the body portion by a fold line so as to extend substantially perpendicular to the body portion; and a mounting tab coupled to the first end of the body portion by a fold line so as to extend substantially perpendicular to the body portion.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

Referring now to the drawings which form a part of this original disclosure in which.

DETAILED DESCRIPTION OF THE INVENTION

Figure 1:
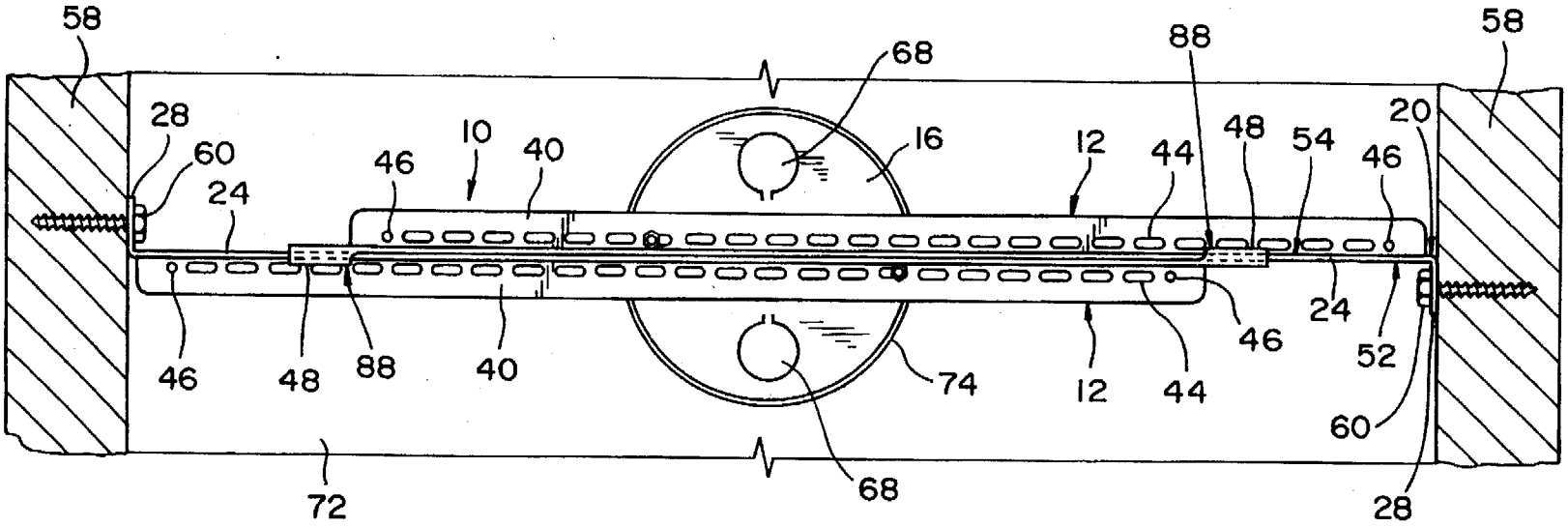
FIG. 1 is a top plan view of a hanger assembly coupled to a pair of joists and having an electrical box coupled thereto in accordance with a first embodiment of the present invention.
Figure 2:
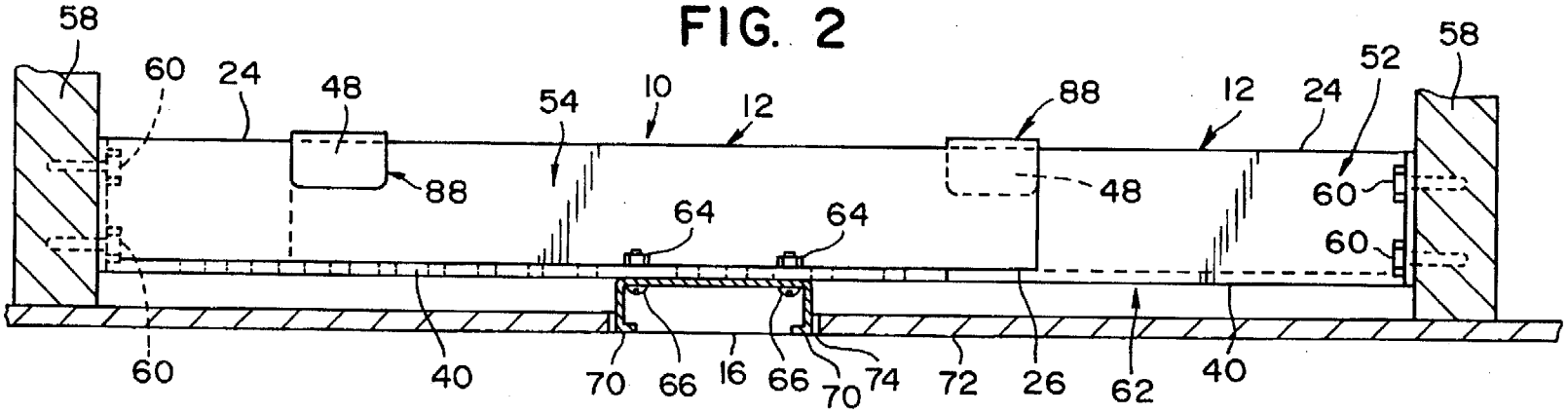
FIG. 2 is a side elevational view of the hanger assembly illustrated in FIG. 1 with the electrical box illustrated in cross-section.
Figure 3:
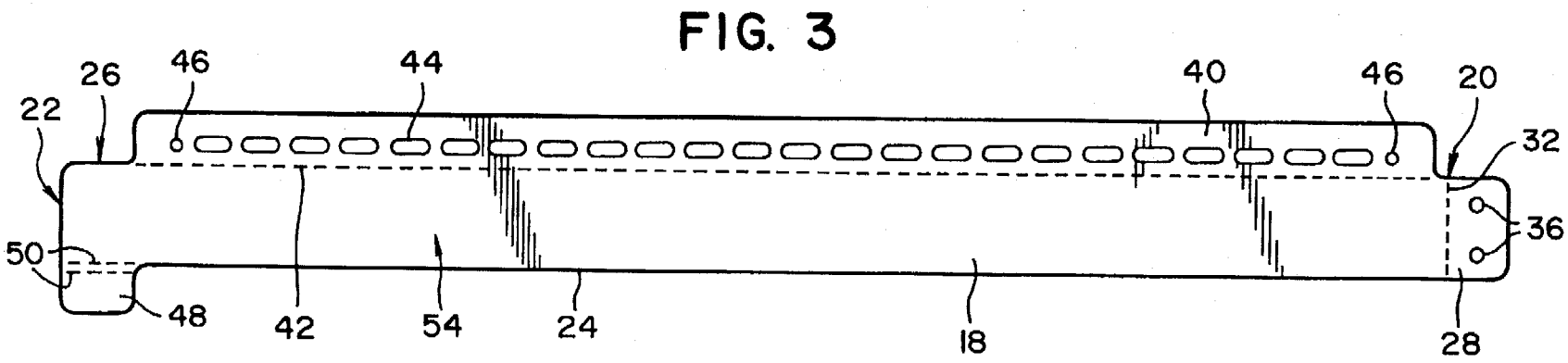
FIG. 3 is a top plan view of a blank for forming a support member for a hanger assembly in accordance with a first embodiment of the invention.

An adjustable bar hanger assembly 10 in accordance with a first embodiment of the present invention is shown in FIGS. 1–6. Hanger assembly 10 includes a pair of the interlocking, complementary support members 12. Each of the support members 12 are formed by folding a blank as shown in FIG. 3. Preferably, support members 12 are identical and can be constructed from a single die. In use, hanger assembly 10 extends between and is attached to a pair of spaced-apart structural supports 58 as seen in FIGS. 1 and 2. An electrical box 16, electrical pan or other fixture is coupled to at least one of the interlocking support members 12 which make up bar hanger assembly 10.

Referring to FIG. 3, the blank for each support member 12 is made from a sheet material having sufficient strength and rigidity to support an article such as a ceiling fan, lighting fixture or other heavy electrical fixture. In preferred embodiments, the blank is punched, pressed, cut or otherwise formed from sheet metal, such as galvanized steel, which can be folded and shaped to form a rigid structure. As shown in FIG. 3, the blank forming each of the support members 12 includes a substantially elongated body portion 18 having a first transverse end 20, a second transverse end 22, a first longitudinal side edge 24 and a second longitudinal side edge 26.

A mounting tab 28 is coupled to first end 20 of body portion 18 preferably by fold a line 32. Mounting tab 28 includes a pair of mounting apertures 36 dimensioned for receiving a mounting screw or other fastener as discussed hereinafter in greater detail. While a pair of spaced-apart apertures are illustrated in mounting tab 28, it will be apparent to those skilled in the art from this disclosure that a single aperture or additional apertures can be provided. In alternative embodiments, mounting tab 28 can be formed with punched tabs or prongs (not shown) which can be shaped and used as a nailing tab. In preferred embodiments, mounting tab 28 has a width substantially equal to the width of body portion 18 and a length sufficient to provide strength for securing tab 28 and body portion 18 to a support structure.

An elongated mounting flange 40 is coupled to second longitudinal side edge 26, preferably by a fold line 42. In preferred embodiments, mounting flange 40 has a length extending substantially from first end 20 of body portion 18 to within a short distance from second end 22 of body portion 18. Mounting flange 40 is dimensioned to provide increased strength to body portion 18 and to provide an adequate mounting surface for electrical box 16 or the like. Alternatively, mounting flange 40 extends the entire length of body portion 18 from first end 20 to second end 22.

Mounting flange 40 preferably includes a plurality of spaced-apart mounting apertures or slots 44. Apertures 44 are dimensioned to receive a mounting screw or other fastener as discussed hereinafter in greater detail. In the embodiment shown in FIG. 1, apertures 44 are elongated in the longitudinal direction with respect to the longitudinal dimension of support member 12 to allow some longitudinal adjustment of the mounting screws. In embodiments of the invention as illustrated, a substantially circular mounting aperture 46 is provided at the opposite longitudinal ends of mounting flange 40. Apertures 44 and 46 can be punched or pressed to form a collar which can be threaded for receiving a screw or bolt.

A coupling tab 48 is coupled to first longitudinal side edge 24 adjacent second end 22 by a pair of closely spaced parallel fold lines 50. As shown in FIG. 3, coupling tab 48 initially lies in the same plane as body portion 18 and extends substantially perpendicular to the longitudinal dimension of body portion 18 prior to folding.

Figure 4:
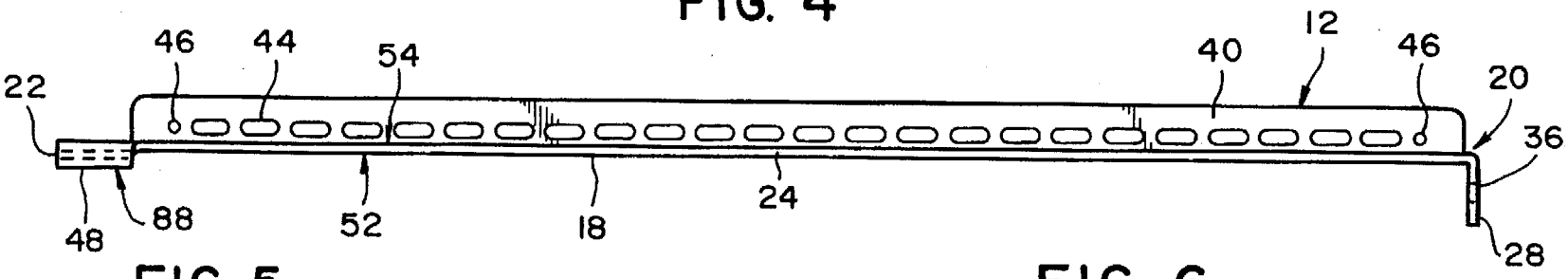
FIG. 4 is a top plan view of the folded support member for the hanger assembly formed from folding the blank of FIG. 3.
Figure 6:
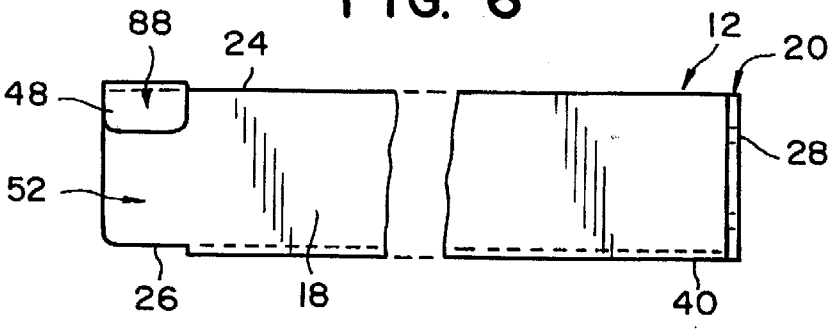
FIG. 6 is a partial side elevational view of the folded support member illustrated in FIGS. 4 and 5.
Figure 5:
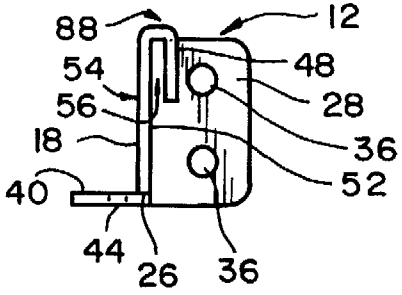
FIG. 5 is a left end elevational view of the folded support member illustrated in FIG. 4.

Support member 12 is formed from the blank of FIG. 3 by folding the blank along fold lines 32, 42 and 50. In particular, mounting tab 28 is folded along fold line 32 until mounting tab 28 extends perpendicular to body portion 18 as shown in FIGS. 4–6. In the embodiment shown, mounting tab 28 is folded toward first side 52 of body portion 18. Mounting flange 40 is folded about fold line 42 to extend substantially perpendicular to body portion 18 in the direction of the second side 54 of body portion 18.

Coupling tab 48 is then folded along parallel fold lines 50 to form a substantially U-shaped, downwardly open, hook-like coupling member 88 which opens downwardly to form a slot or groove 56 for receiving the body portion 18 of another support member 12. Coupling tab 48 is also folded toward first side 52 of body portion 18 as shown in Figures 2–4. Coupling tab 48 in a preferred form of the invention is folded to be substantially parallel to and spaced a slight distance from body portion 18. Coupling tab 48 has a length and width sufficient to securely couple a complementary hanger support member thereto, while permitting the complementary hanger support member to be slidably received by its coupling tab 48.

Hanger assembly 10 is assembled by mating the first sides 52 of body portions 18 of two complementing support members 12 with mounting flanges 40 extending outwardly from one another. Coupling tabs 48 of coupling members 88 are then hooked over first longitudinal side edges 24 of body portions 18 of the complementing support members 12. In this manner, coupling tabs 48 resist downward movement of second ends 22 of body portions 18 with respect to first longitudinal edges 24 of the complementing support members 12. Support members 12 are also slidable with respect to each other in the longitudinal direction.

Each support member 12 has a length so that when coupled together, the assembly is expandable a distance to span between a pair of spaced-apart support members. In preferred embodiments, hanger assembly 10 is expandable from about 14 inches to about 26½ inches to accommodate most standard support spacings, including the standard sixteen inch and twenty-four inch center to center spacing for wall studs and ceiling joists.

In use, hanger assembly 10 is initially placed between a pair of substantially parallel support members 58 and extended in the longitudinal direction until mounting tabs 28 of the complementing support members 12 contact the respective support members 58. A lag screw 60 or other suitable fastening device is inserted through the apertures in mounting tabs 28 and into support member 58 to securely couple mounting tabs 28 to the respective support member. Once mounting tabs 28 are secured to the support members 58 and coupling tabs 88 are hooked to the complementary support members 12, the support members 12 resist transverse movement with respect to each other and resist movement with respect to each other in the direction of second longitudinal side edges 26. As shown in FIG. 2, each of the support members 12 along with tabs 48 engage and support the other to transfer the load back to the mounting screws 60.

Hanger assembly 10 is particularly suitable for spanning a pair of spaced apart ceiling joists, trusses and the like. In alternative embodiments, hanger assembly 10 can span a pair of vertical supports such as wall studs formed of wood, metal or other suitable materials. In preferred embodiments, hanger assembly 10 is coupled to a pair of ceiling joists and oriented with mounting flanges 40 positioned horizontally and defining a lower edge 62 and load supporting surface of hanger assembly 10. The load from electrical box 16 is applied to mounting flanges 40 at their lower edges 62 so that the load is transferred through support members 12 to coupling tabs 48 which then transfers the load to upper edges 24 of the complementing body portions 18. When hanger assembly 10 is attached to supports 58 in the position shown in FIG. 2, hanger assembly 10 is able to support a substantial load since downward movement of second ends 22 is resisted by coupling tabs 48 engaging the upper edges 24 of the complementary support member 12.

In preferred embodiments of the invention, hanger assembly 10 includes a load coupled to at least one mounting flange 40 such as, for example, an electrical box 16, electrical pan, lighting fixture, or other device. Generally, it is desirable to couple electrical box 16 to hanger assembly 10 after hanger assembly 10 is attached to the support members 58, although it can be attached before. Electrical box 16 can be coupled to hanger assembly 10 at any desired location along the length of the assembly, but is preferably coupled to the areas where support members 12 overlap. Electrical box 16 is preferably a standard construction having conventional electrical knock-outs 68 and is dimensioned for supporting lighting fixtures, ceiling fans or other heavy ceiling fixtures. One example of a suitable electrical box for supporting a ceiling fan is disclosed in U.S. Pat. No. 4,892,211 which is hereby incorporated herein by reference. Electrical box 16 is coupled to mounting flanges 40 using screws, bolts, nuts and lock washers or other fastening devices.

In the embodiment illustrated in FIGS. 1 and 2, the fastener is a nut 64 and bolt 66 where bolt 66 extends through a mounting hole in electrical box 16 and through one of apertures 44. While hexagonal nut 64 is illustrated for use with bolt 66, it will be apparent to those skilled in the art from this disclosure that a square nut can be used instead. In fact, a square nut may even be preferred in certain fabrications of the hanger assembly 10. For example, slots 44 of each of the support members 12 can be spaced away from body portion 18 so that when bolt 66 has a square nut threaded thereon and bolt 66 is positioned in one of the slots, one of the side edges of the square nut just barely touches body portion 18. Thus, the square nut is prevented from rotating during rotation of bolt 66 since one side edge of the square nut engages body portion 18.

As shown in FIG. 1, a single nut and bolt couple electrical box 16 to each mounting flange 40 of each support member 12. Of course, additional fasteners can be used to further strengthen the assembly. Securely coupling electrical box 16 to each mounting flange 40 forms a unitary hanger assembly 10 and fixes the position of support members 12 with respect to each other and with respect to electrical box 16. The load is then coupled to electrical box 16 in a conventional manner. As shown in FIG. 2, the load is transferred through electrical box 16 and support members 12 to mounting screws 60.

Hanger assembly 10 is preferably positioned between support members 58 so that the outer edge 70 of electrical box 16 is substantially flush with the outer surface of ceiling 72 or wall surface. As shown in FIG. 2, electrical box 16 extends through a cut-out 74 in ceiling 72.

In an alternative manner of installation of the assembly of the invention, electrical box 16 is initially coupled to one of support members 12 of hanger assembly 10 at two points of either mounting flange 40 to securely fix the position of electrical box 16 relative to the respective support member 12. The complementing support member 12 is then coupled to the other support member 12 in the manner discussed above. In this fashion, the support members 12 are slidably connected together to permit adjustment to the desired length. Electrical box 16 is then coupled to the remaining mounting flange by a suitable fastener to fix the position of support members 12 relative to each other and to electrical box 16.

Hanger assembly 10 is suitable for new construction as well as adaptation to existing structures. In an existing structure, opening 74 is cut in the ceiling or wall 72 of sufficient size to receive the electrical box 16. The hanger assembly 10 is then passed through the opening and fastened to the wall studs, ceiling joists or other support members. Thereafter, the electrical box 16 is fastened to the mounting flanges 40.

Embodiment of FIGS. 7–10

In an alternative embodiment of the present invention illustrated in FIGS. 7–10, a hanger bar 12' is formed from a blank in a manner similar to the embodiment of FIGS. 1–6. In particular, the only significant difference between this embodiment and the preceding embodiment is that mounting tab 28 of the preceding embodiment has been modified. Accordingly, this alternative embodiment will not be discussed or illustrated in detail. In fact, in this embodiment, identical components are identified by the same reference numbers with the addition of a prime.

Figure 7:
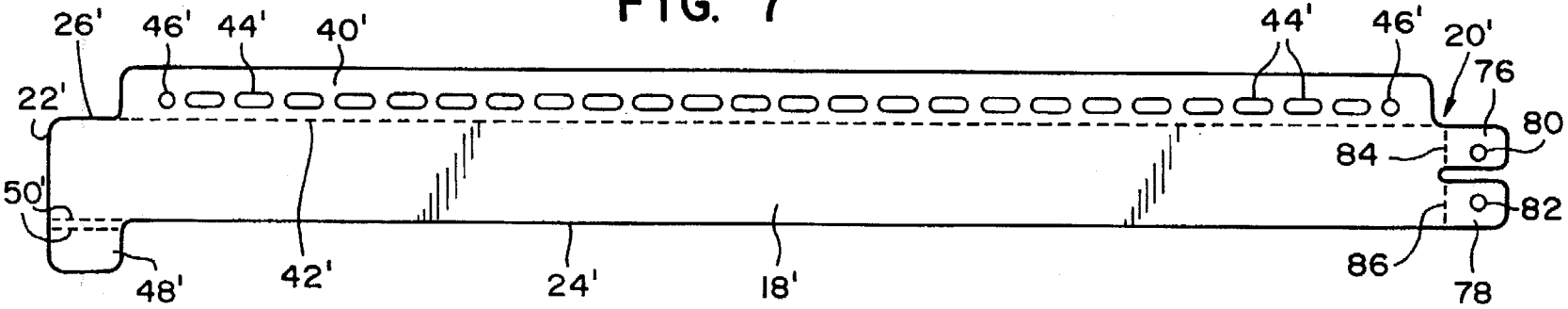
FIG. 7 is a top plan view of a blank for forming a support member for a hanger assembly in accordance with a second embodiment of the invention.

The blank of this embodiment differs from the blank shown in FIG. 3 by including a pair of mounting tabs 76 and 78 extending from first end 20'. Mounting tabs 76 and 78 each has a mounting aperture 80 and 82, respectively, for receiving a screw or other fastener. As shown in FIG. 7, mounting tabs 76 and 78 are substantially parallel to each other and spaced-apart a slight distance. Mounting tabs 76 and 78 are also coupled to body portion 18' by fold lines 84 and 86, respectively.

Figure 8:
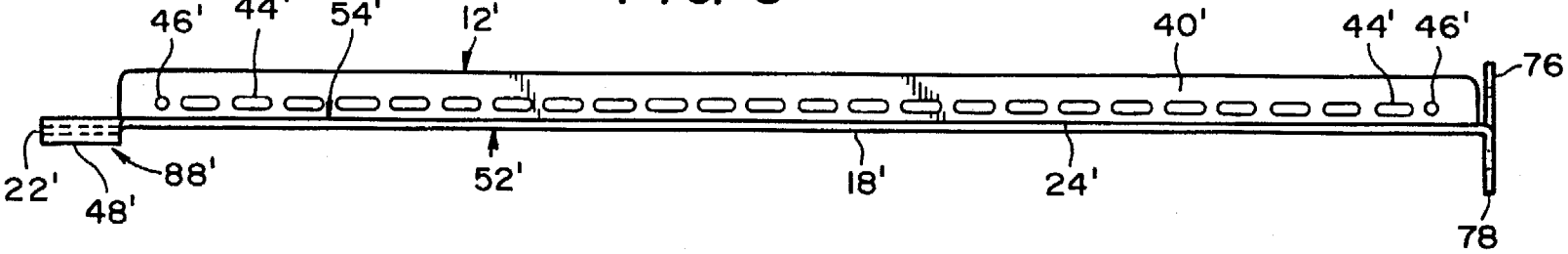
FIG. 8 is a top plan view of the folded hanger support member formed from folding the blank of FIG. 7.
Figure 10:
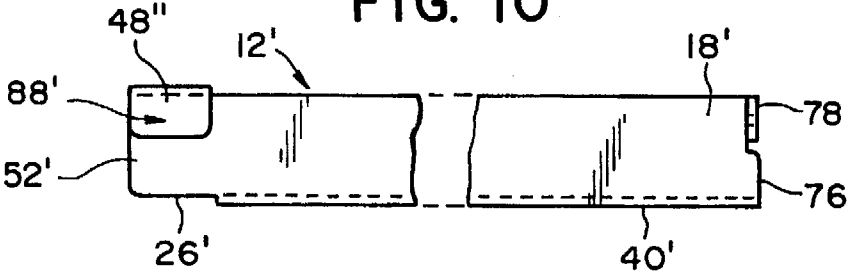
FIG. 10 is a partial side elevational view of the support member illustrated in FIG. 8.
Figure 9:
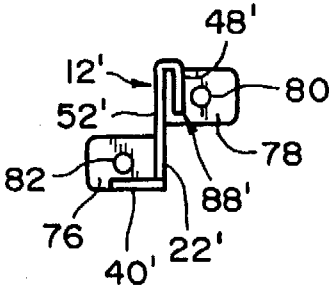
FIG. 9 is an end elevational view of the hanger support member illustrated in FIG. 8.

Support member 12' is formed by folding the blank in substantially the same manner as discussed above in the previous embodiment. Mounting flange 40' is folded along edge 26' until it extends perpendicular to body portion 18' and coupling tab 48' is folded to form a substantially U-shaped hook-shaped coupling member 88'. Mounting tab 76 is folded along fold line 84 in a first direction to be perpendicular to body 18'. Mounting tab 78 is folded along fold line 86 in a second direction opposite tab 76 so as to be perpendicular with body 18'. As shown in FIG. 8, mounting tabs 76, 78 lie in substantially the same plane for coupling to a support member (not shown).

A pair of support members 12' are coupled together in the same manner as in the embodiment of FIGS. 1–6 to form a hanger assembly. The hanger assembly is mounted in a similar manner by expanding the hanger support members with respect to each other until mounting tabs 76 and 78 contact the support member. Mounting tabs 76 and 78 are fixed to the support members by fastening devices, such as a lag screw, passing through apertures 80 and 82 and into the support members. An electrical box or other load bearing device is then coupled to mounting flanges 40' to fix the position of support members 12' with respect to each other. The load is similarly transferred to the mounting screws by the hanger supports.

Embodiment of FIGS. 11–21

Referring now to FIGS. 11–21, a hanger assembly 110 in accordance with a third embodiment of the present invention is illustrated. Hanger assembly 110 is similar in construction to hanger assembly 10 of the first embodiment as discussed above. However, hanger assembly 110 has been modified over the first embodiment to provide additional stability and ease of assembly. In view of the similarities between the two embodiments, this alternative embodiment of the present invention will not be discussed in detail.

Hanger assembly 110 includes a pair of interlocking, complementary support members 112. Preferably, support members 112 are identical and can be constructed from a single die to reduce manufacturing costs. In use, hanger assembly 110 extends between a pair of joists or support 114. An electrical box or pan 116 is coupled to at least one of the interlocking support members 112.

Figure 21:
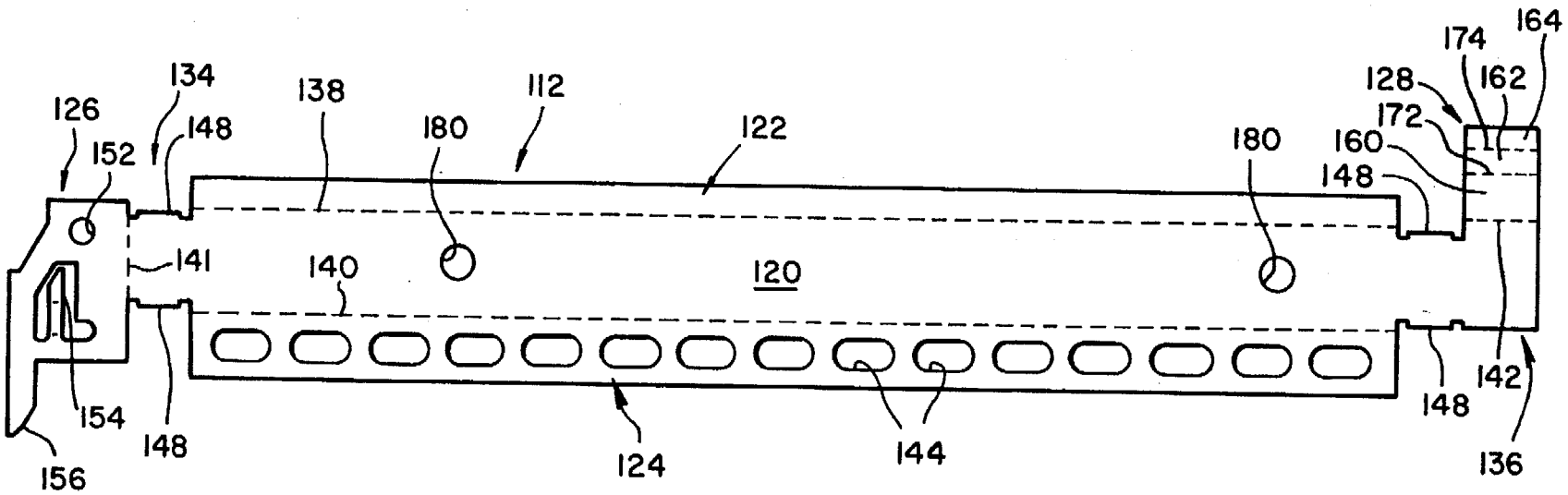
FIG. 21 is a top plan view of a blank for forming a support member for the hanger assembly illustrated in FIGS. 11–20.

Support members 112 are constructed from a sheet metal material having sufficient strength and rigidity to support an article such as a ceiling fan, lighting fixture or other heavy electrical fixture between supports or joists 114. In particular, the sheet metal material is first punched, pressed or cut to form a blank as seen in FIG. 21 which can be folded along the broken lines shown in FIG. 21 and shaped into a rigid structure such as support member 112. One suitable sheet metal material for support members 112 is galvanized steel. Of course, other suitable sheet materials could be used. Preferably, each support member 112 is constructed as one-piece unitary members from a single blank of sheet material As best seen in FIGS. 13–16, each of the support members 112 preferably includes an elongated body portion 120, an upper guide flange 122, a lower load supporting flange 124, a mounting tab 126 and a hook-shaped coupling member 128. Elongated body portion 120 is substantially rectangular, and has an upper longitudinal side edge 130, a lower longitudinal side edge 132, a first end 134 and a second end 136.

Figure 18:
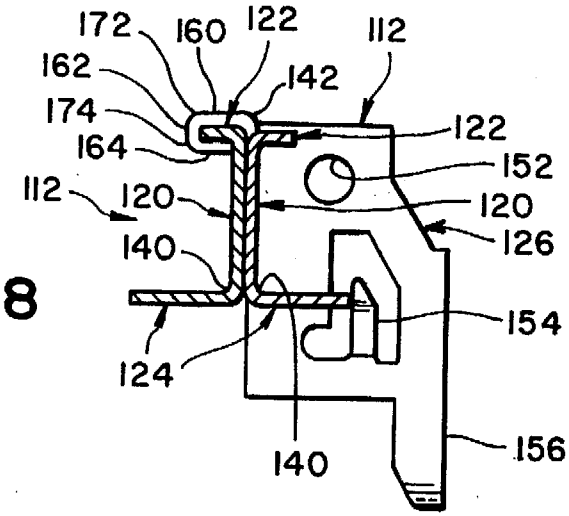
FIG. 18 is an enlarged cross-sectional view of the hanger assembly illustrated in FIGS. 11 and 12 taken along section line 18—18 of FIG. 11.
Figure 20:
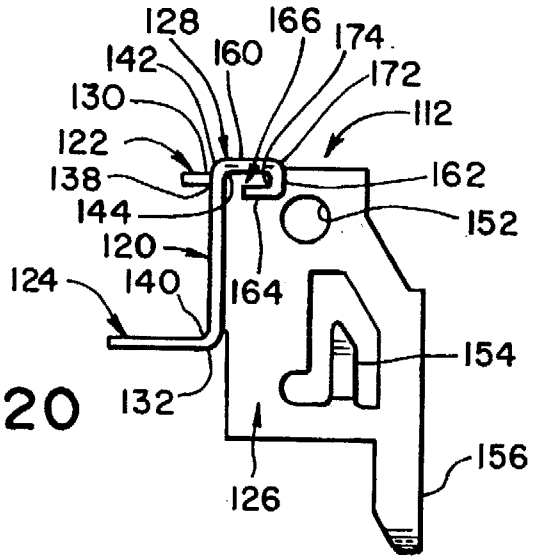
FIG. 20 is a right end elevational view of one of the support members illustrated in FIGS. 11–19.
Figure 17:
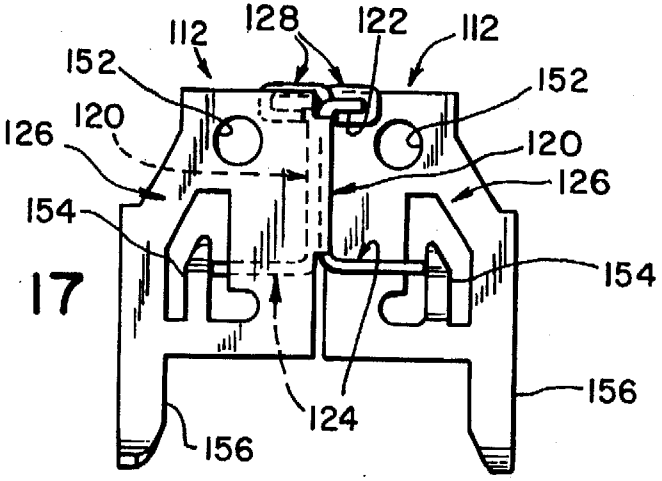
FIG. 17 is a left end elevational view of the hanger assembly illustrated in FIGS. 11–14, with the electrical box removed.
Figure 19:
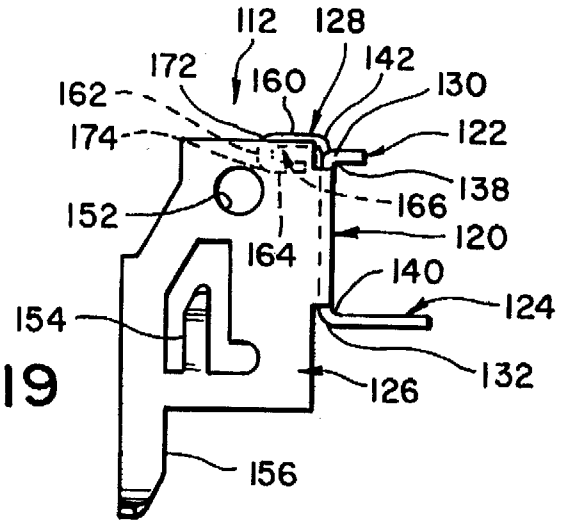
FIG. 19 is a left end elevational view of one of the support members illustrated in FIGS. 11–18.

As best seen in FIGS. 17–21, upper flange 122 of each support member 112 is coupled to body portion 120 at side edge 130 by a fold line 138, while lower flange 124 is coupled to body portion 120 at lower longitudinal side edge 132 by a fold line 140. Upper flange 122 extends substantially perpendicular to body portion 120. Likewise, lower flange 124 extends substantially perpendicular to body portion 120. Also, upper and lower flanges 122 and 124 extend outwardly from body portion 120 in the same direction so that each support member 112 has a substantially C-shaped transverse cross-section as seen in FIG. 18.

Figure 15:
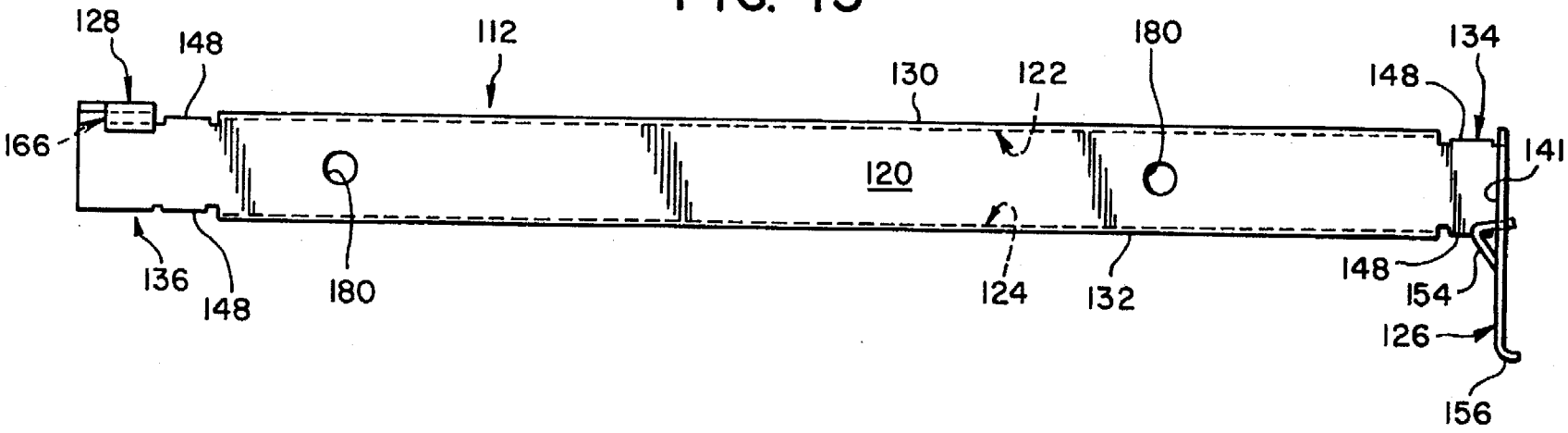
FIG. 15 is a front side elevational view of one of the support members illustrated in FIGS. 11–14.
Figure 16:
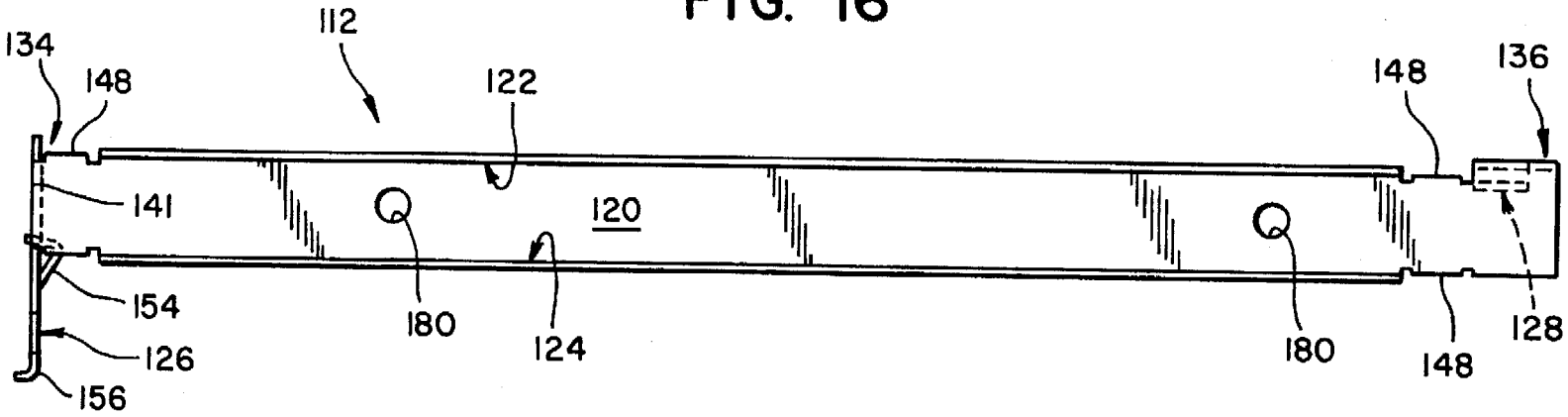
FIG. 16 is a rear side elevational view of one of the support members illustrated in FIGS. 11–15.

As best seen in FIGS. 15, 16 and 21, mounting tab 126 is coupled to body portion 120 at first end 134 by a fold line 141, and extends substantially perpendicularly to body portion 120. Mounting tab 126 extends in the opposite direction from upper flange 122 and lower flange 124. Also, mounting tab 126 is arranged substantially perpendicular to upper and lower flanges 122 and 124.

As best seen in FIGS. 17-21, coupling member 128 is also coupled to the upper longitudinal side edge 130 of body portion 120 by a fold line 142. However, fold line 142 is spaced from fold line 138 by approximately the thickness of the sheet material forming upper flange 122.

The upper and lower longitudinal side edges 130 and 132 of support members 112 have a pair of cutouts 148 for aiding in the manufacture of support members 112 via conventional manufacturing techniques. One of the cutouts 148 is located at each end of upper and lower flanges 122 and 124. Preferably, one of the cutouts 148 is positioned between the one end of upper flange 122 and coupling member 128. The cutout 148 positioned between coupling member 128 and one end of upper flange 122 is designed and sized to receive coupling member 128 of the other support member 112 when the pair of support members 112 are being coupled together.

As seen in FIGS. 11–14, lower load supporting flange 124 extends farther out from body portion 120 than upper flange 122, and includes a plurality of mounting apertures 144 which are preferably in the form of elongated holes or slots. These elongated mounting apertures 144 allow longitudinal adjustment of the overall length of hanger assembly 110 as discussed below in more detail.

Figure 11:
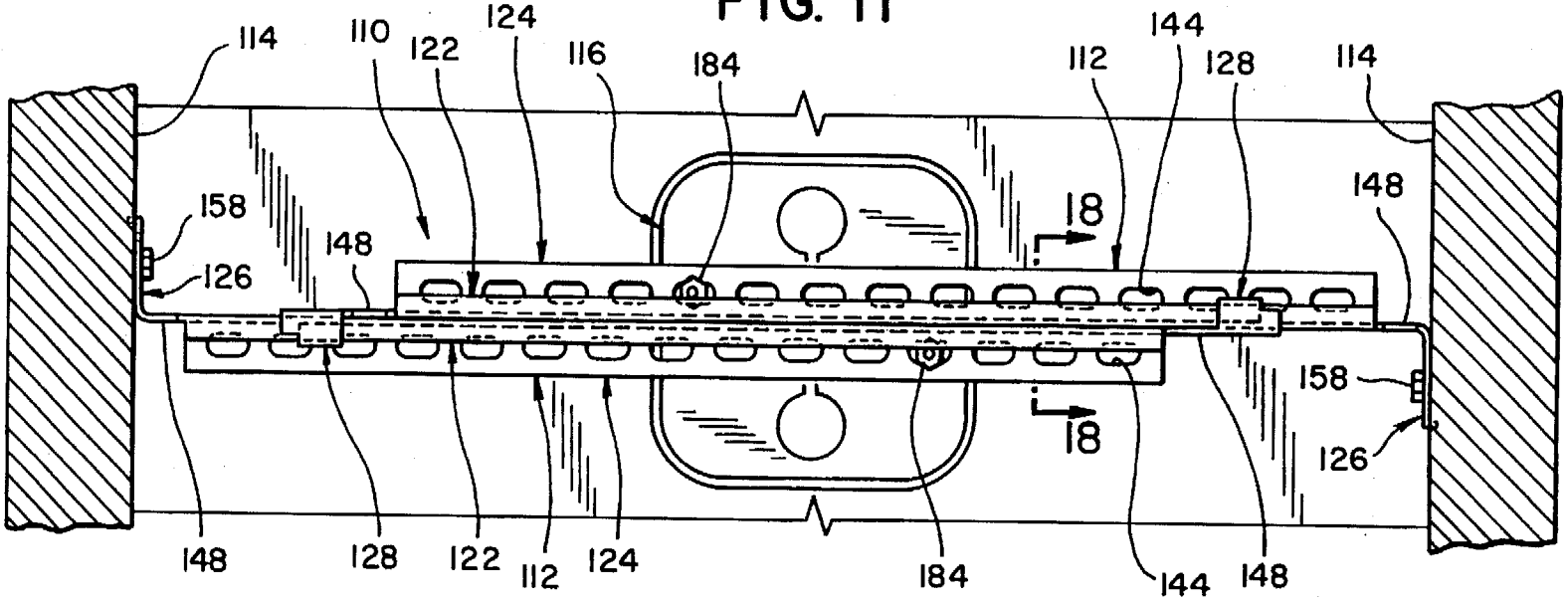
FIG. 11 is a top plan view of a hanger assembly coupled to a pair of joists in accordance with a third embodiment of the present invention, and with an electrical box coupled thereto.
Figure 12:
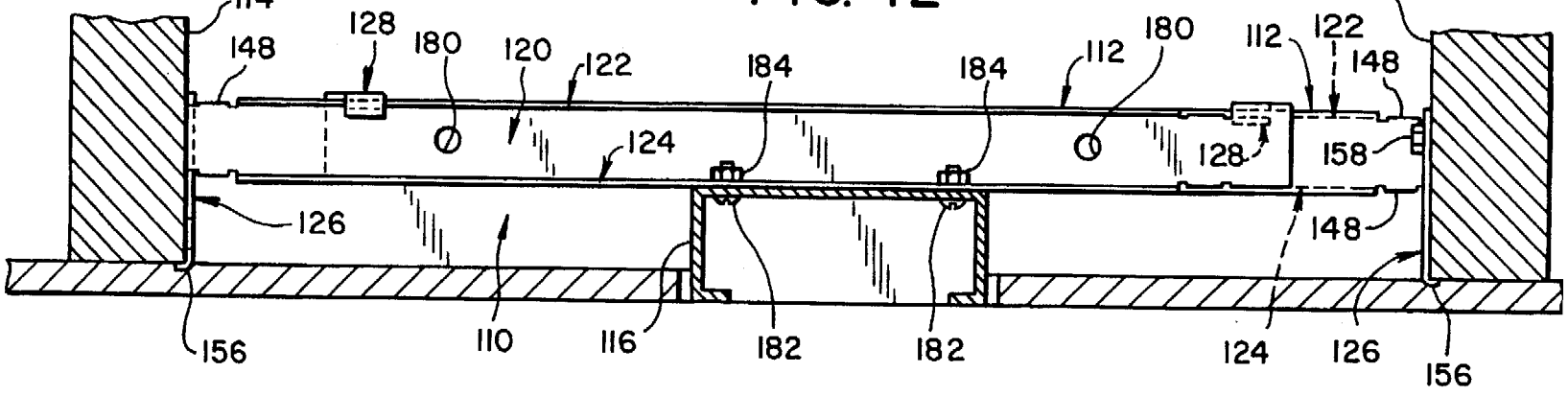
FIG. 12 is a side elevational view of the hanger assembly, illustrated in FIG. 11, with the electrical box illustrated in cross-section.
Figure 13:
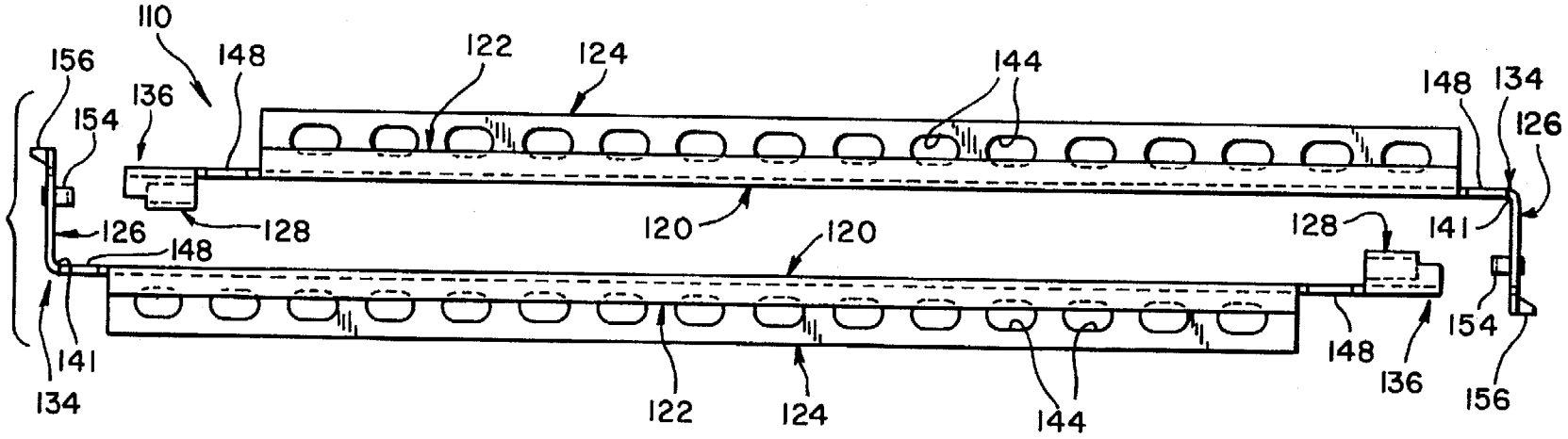
FIG. 13 is an exploded top plan view of the pair of support members illustrated in FIGS. 11 and 12.
Figure 14:
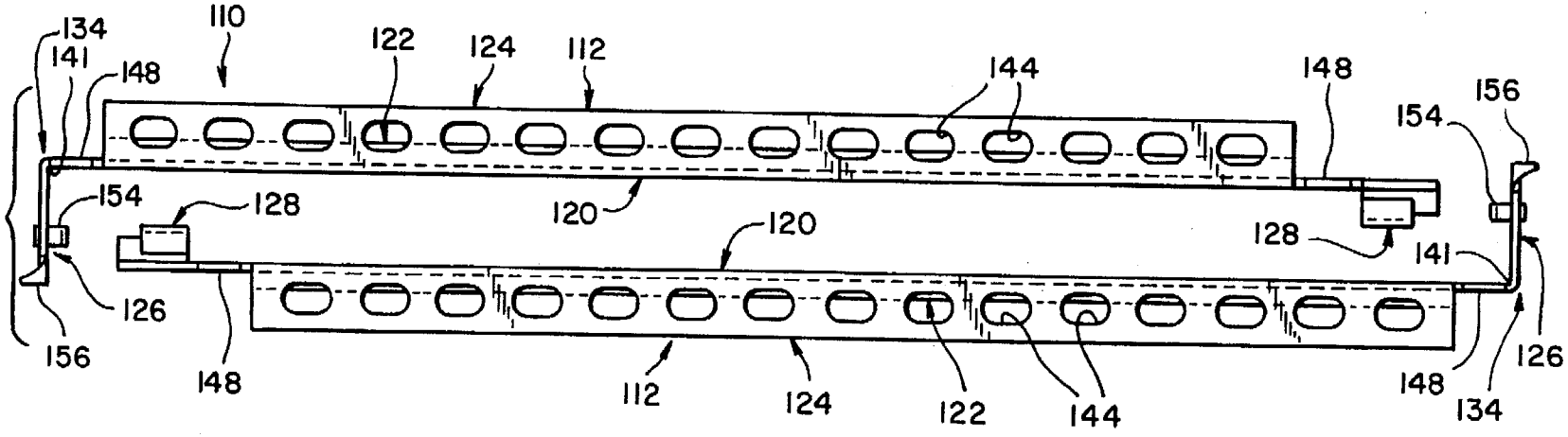
FIG. 14 is an exploded bottom plan view of the pair of support members illustrated in FIGS. 11–13.

As best seen in FIGS. 17–20, mounting tab 126 includes a mounting hole 152, a nailing barb or prong 154, and a positioning hook 156. During installation of hanger assembly 110, mounting tab 126 is positioned against the side of joist 114 such that positioning hook 156 of mounting tab engages the face of joist 114 to provide the exact set-back distance required for a 1½" deep standard electrical box 116 when installed with ½" plasterboard. Accordingly, no measuring is necessary for obtaining the correct location or position of hanger assembly 110. Rather, just hold hanger assembly 110 in place and then hit prong 154 of each support member 112 to initially secure hanger assembly 110 to joists 114. Then, a lag screw, nail or other fastener 158, as seen in FIGS. 11 and 12, is inserted through mounting hole 150 of each mounting tab 126 to permanently secure hanger assembly 110 to joists 114.

As best seen in FIGS. 17–21, hook-shaped coupling member 128 includes a first portion 160, a second portion 162 and a third portion 164, which are all arranged to form a guide channel 166 designed to receive the upper guide flange 122 of the other support member 112. More specifically, first portion 160 is coupled to the upper side edge 130 of body portion 120 via a fold line 142 so as to extend substantially perpendicularly thereto. Second portion 162 is coupled to first portion 160 via a fold line 172 and extends substantially downwardly from first portion 160 so as to be parallel to body portion 120. Third portion 164 is coupled to second portion 162 by a fold line 174 and extends substantially perpendicularly thereto. Third portion 164 extends inwardly towards body portion 120 from second portion 162 and substantially parallel to first portion 160. However, the free end of third portion 164 is spaced from body portion 120 by at least the thickness of the material forming body portion 120 so that upper longitudinal side edge 130 of body portion 120 of one support member 112 can slide between the free end of third portion 164 and body portion 120 of the other support member 112.

Body portion 120 can also be provided with a pair of pilot holes 180. The pilot hole 180, which is closest to coupling member 128, is designed so that support members 112 can be secured together by a fastener to form a rigid two foot hanger assembly 110. More specifically, when hanger assembly 110 is positioned between joists that are spaced two feet apart on their centers, then the pilot hole 180 of a first support members 112 closest to coupling members 128 will align with the same pilot hole 180 on the complementary support member 112 to allow a nut and bolt arrangement to pass therethrough for fixedly coupling support members 112 together. This gives added rigidity to hanger assembly 110. Of course, it is not necessary to utilize such a nut and bolt arrangement.

Installation of Hanger Assembly 110

In use, hanger assembly 110 is initially assembled by placing the hook-shaped coupling members 128 in the cut outs 148 of the other support member 112. Next, the two support members 112 are slid axially or longitudinally relative to each other so that the upper flanges 122 are received in channels 166 of coupling members 128.

The upper flanges 122 and coupling members 128 of support members 112, which comprise hanger assembly 110, perform three basic functions: (1) they slidably couple support members 112 together; (2) they provide rigidity and support between support members 112 for supporting a downward load (e.g. fan fixture) coupled thereto via electrical box 116; and (3) they provide rigidity and support between support members 112 for supporting an upward load or force when using positioning hooks 156. While the first and second functions of upper flanges 122 and coupling members 128 are also perform the hanger assemblies of the first and second embodiments of the present invention, the third function is not perform by the hanger assemblies of the first and second embodiments.

Now, the hanger assembly 110 is placed between a pair of substantially parallel supports or joists 114 until the mounting tabs 126 of each support member 112 engages the side of joist 114. Of course, when installing hanger assembly 110, positioning hook 156 engages the face of the joists 114 to provide the exact set-back distance for the electrical box 116 used with hanger assembly 110. The installer now hits the nailing prong 154 in each of the mounting tabs 126 to temporarily secure hanger assembly 110 to joists 114. In particular, when the installer hits nailing prongs 154, the nailing prongs 154 penetrate into the joists 114 to temporarily secure hanger assembly 110 in place.

Now, the installer can use lag bolts, nails or other fasteners 158 to secure hanger assembly 110 between joists 114. Specifically, the lag screws 158 are inserted through the mounting holes 152 of the mounting tabs 126 and threaded into the joists 114.

Optionally, a nut and bolt arrangement can be used to interconnect support members 112 together. In particular, a bolt is inserted through each of the pilot holes 180 of body portions 120 for securing the support members 112 together to provide additional rigidity, if needed or desired. Preferably, pilot holes 180 are located so that the pilot holes 180 of one of the support members 112 align with the pilot holes of the other support member 112, when hanger assembly 110 is installed between joists that are spaced two feet apart on their centers.

Finally, the electrical box 116 is attached to the lower flanges 124 of support members 112 via a pair of bolts 182 and nuts 184. Specifically, bolts 182 are passed through holes in the bottom of the electrical box 116 and then pass through a pair of mounting apertures 144 of at least one or both of the lower flanges 124 of the support members 112, and then the nuts 184 are applied to the free ends of the bolts 182. It will be apparent to those skilled in the art that bolts 182 can pass through a pair of mounting apertures 144 in one of the lower flanges 124 of support members 112, or can pass through one aperture in each of the lower flanges 124 of support members 112. Also, it will be apparent to those skilled in the art that square nuts can be used instead of the hexagonal nuts 184, which are illustrated in the drawings. As mentioned above, square nuts may in fact be preferred over using hexagonal nuts.

While only three embodiments are disclosed to illustrate the invention, it will be understood by those skilled in the art that various changes and modifications can be made therein without departing from the spirit and scope of the invention as defined in the appended claims.

What is claimed is:

1. A bar hanger assembly for supporting a load between a pair of substantially parallel spaced-apart supports, said hanger assembly comprising:

first and second complementary support members slidably coupled together, each of said support members being formed from a sheet material and including a body portion having a longitudinal dimension, with first and second ends, and first and second longitudinal side edges;

a hook-shaped coupling member coupled to said first side edge for slidably engaging said first side edge of the complementary said support member;

a load supporting flange coupled to said second longitudinal side edge of said body portion and extending substantially perpendicular to said body portion; and a mounting tab coupled to said first end of said body portion and extending substantially perpendicular to said body portion.

2. The bar hanger assembly according to claim 1, wherein each of said mounting tabs includes at least one mounting hole for receiving a mounting fastener therethrough.

3. The bar hanger assembly according to claim 1, wherein said load supporting flange includes a plurality of mounting apertures for receiving at least one mounting fastener.

4. The bar hanger assembly according to claim 3, wherein said load supporting flange of each said support member extends from its said coupling member to its said first end of its said body portion.

5. The bar hanger assembly according to claim 1, wherein said coupling member of each said support member is coupled adjacent its said second end of its said body portion.

6. The bar hanger assembly according to claim 1, further comprising an electrical box coupled to said load supporting flange of at least one of said support members.

7. The bar hanger assembly according to claim 1, wherein said coupling member includes a first portion coupled to said first side edge and extending substantially perpendicular to said body portion; and a second portion coupled to said first portion and extending substantially parallel to said body portion.

8. The bar hanger assembly according to claim 7, wherein said coupling member further includes a third portion coupled to said second portion and extending towards its said body portion to form a guide channel.

9. The bar hanger assembly according to claim 8, wherein each of said first and second support members includes a guide flange coupled to its said first side edge for being slidably received within said guide channel of the complementary said support members.

10. The bar hanger assembly according to claim 9, wherein said guide flange and said mounting flange extend outwardly from its respective said body portion.

11. The bar hanger assembly according to claim 10, wherein said first side edges of said support members each have at least one cutout therein for assembling said first and second support members together.

12. The bar hanger assembly according to claim 11, wherein each of said mounting tabs includes at least one nailing prong.

13. A support member formed of a rigid sheet material, comprising:

a body having a longitudinal dimension, with first and second ends, and first and second longitudinal side edges;

a hook-shaped coupling member coupled to said first side edge by a first fold line, said coupling member including at least a first portion extending outwardly from said body portion at said first fold line and a second portion extending from said first portion via a second fold line to define a hook-shaped coupling member for slidably engaging said first side edge of a complementary support member;

a load supporting flange coupled to said second longitudinal side edge of said body portion by a fold line so as to extend substantially perpendicular to said body portion; and a mounting tab coupled to said first end of said body portion by a fold line so as to extend substantially perpendicular to said body portion.

14. The support member according to claim 13, wherein said mounting tab includes at least one mounting hole for receiving a mounting fastener therethrough.

15. The support member according to claim 14, wherein said load supporting flange includes a plurality of mounting apertures for receiving at least one mounting fastener.

16. The support member according to claim 15, wherein said load supporting flange extends from its said coupling member to its said first end of its said body portion.

17. The support member according to claim 16, wherein said coupling member further includes a third portion coupled to said second portion and extending towards its said body portion to form a guide channel.

18. The support member according to claim 17, wherein said support member includes a guide flange coupled to said first side edge for being slidably received within said guide channel of another support member.

19. The support member according to claim 18, wherein said first side edge of said support member has a cutout therein for assembling said first support member to another support member.

20. The support member according to claim 19, wherein said mounting tabs includes at least one nailing prong.

21. A hanger assembly for supporting a load between a pair of substantially parallel spaced-apart supports, said hanger assembly comprising:

first and second complementary support members slidably coupled together, each of said support members being formed from a sheet material and including a body portion having a longitudinal dimension, first and second ends, and first and second longitudinal side edges;

a hook-shaped coupling member coupled to said first side edge by a pair of parallel fold lines, for slidably engaging the first side edge of the complementary support member, thereby resisting downward movement of said second end of said body relative the complementary support member in the direction of said second side edge.

22. The hanger assembly of claim 21, wherein each of said support members further comprises a first mounting tab coupled to said first end of said body portion by a fold line and extending substantially perpendicular to said body portion in a first direction, and a second mounting tab coupled to said body portion by a fold line and extending substantially perpendicular to said body portion in a second direction.

23. The hanger assembly of claim 22, wherein each of said first and second mounting tabs includes a mounting hole for receiving a mounting fastener therethrough.

24. The hanger assembly of claim 21, further comprising a load supporting mounting flange coupled to said second longitudinal side edge of said body portion by a fold line and extending substantially perpendicular to said body portion.

25. The hanger assembly of claim 24, wherein said load supporting mounting flange includes a plurality of mounting slots or holes for receiving at least one mounting fastener.

26. The hanger assembly of claim 21, wherein said coupling member has a substantially U-shaped portion coupled to said first edge and a substantially planar portion coupled to said U-shaped portion and extending substantially parallel to said body portion.

27. The hanger assembly of claim 21, further comprising an electrical box coupled to said second side edge of at least one of said support members.

28. A hanger support member formed of a rigid sheet material, comprising:

a body having a longitudinal dimension, first and second ends, and first and second longitudinal side edges; and a coupling tab coupled to said first side edge at said second end and by two substantially parallel fold lines to define a hook-shaped coupling member for slidably engaging the first side edge of a complementary support member.

29. The hanger support member of claim 28, further comprising first and second spaced apart coupling tabs coupled to said body portion at said first end by fold lines.

30. The hanger support member of claim 29, wherein each of said first and second coupling tabs has at least one aperture therein for receiving a mounting fastener.

31. The hanger support member of claim 28, further comprising a mounting flange coupled to said second longitudinal side edge of said body portion by a fold line and having a length extending from said coupling tab to said first end of said body said mounting flange further includes a plurality of spaced-apart apertures therein.

32. A method of supporting an electrical box between a pair of substantially parallel supports comprising the steps of forming a hanger assembly from first and second complementary hanger support members, each said hanger support members comprising a body portion having a longitudinal dimension, first and second ends and an upper and lower longitudinal edge;

a coupling tab coupled to said upper longitudinal edge adjacent said second end and defining a substantially U-shaped hook member, and a mounting flange coupled to said lower edge and extending substantially perpendicular to said body portion, wherein said hanger assembly is formed by hooking said coupling tab of said first hanger support member over the upper edge of said second hanger support member and hooking the coupling tab of said second hanger support member over the upper edge of said first hanger support member, coupling said first end of said first hanger support member to said first support and said first end of said second hanger support member to said second support, and coupling an electrical box to at least one of said mounting flanges of said hanger support members.

33. The method of claim 32, wherein each of said hanger support members further comprises two mounting tabs at said first end and extending substantially perpendicular to said body portion, said method further comprising coupling said mounting tabs of said first and second hanger support members to said first and second supports, respectively.

34. A hanger assembly for supporting a load between a pair of substantially parallel supports comprising:

first and second complementary support members slidably coupled together, each of said support members including a body portion having a longitudinal dimension, first and second ends, and first and second longitudinal edges;

first attachment means, at said first end of said body portion, for attaching said support member to one of said supports;

coupling means, at said second end of said body portion, for slidably receiving the first longitudinal edge of a complementary support member and for resisting movement of said second end in a first direction with respect to said first edge of said complementary support member; and second attachment means, coupled to said second edge of said body portion, for attaching a load to said body portion.

35. The hanger assembly of claim 34, wherein said coupling means comprises a coupling tab coupled to said first edge of said body portion to form a substantially hook-shaped member, for slidably receiving said first edge of said body portion of said complementary support member.

36. The hanger assembly of claim 35, wherein said coupling tab is coupled to said first longitudinal edge and extends toward said second longitudinal edge and substantially parallel to and spaced from said body portion.

37. The hanger assembly of claim 36, wherein said coupling tab is coupled to said body portion by two parallel fold lines.

38. The hanger assembly of claim 34, wherein said first attachment means comprises a first mounting tab coupled to said first end of said body portion and extending substantially perpendicular to said body portion in a first direction, and a second mounting tab coupled to said body portion and extending substantially perpendicular to said body portion in a second direction.

39. The hanger assembly of claim 34, wherein said second attachment means comprises a mounting flange coupled to said body portion along said second longitudinal edge and extending substantially perpendicular to said body portion.

* * * * *